United States Patent [19]

Speak

[11] Patent Number: 4,984,423

[45] Date of Patent: Jan. 15, 1991

[54] AERODYNAMIC LOADING IN GAS TURBINE ENGINES

[75] Inventor: Trevor H. Speak, Dursley, England

[73] Assignee: Rolls-Royce PLC, London, England

[21] Appl. No.: 362,865

[22] Filed: Jun. 7, 1989

[30] Foreign Application Priority Data

Jun. 22, 1988 [GB] United Kingdom ..... 8814779

[51] Int. Cl.[5] ..... F02C 7/20

[52] U.S. Cl. ..... 60/39.31; 60/722

[58] Field of Search ..... 60/39.31, 39.32, 39.36, 60/722, 752

[56] References Cited

U.S. PATENT DOCUMENTS 3,844,115 10/1974 Freid .
4,502,276 3/1985 Pask ..... 60/39.32
4,716,721 1/1988 Pask et al. ..... 60/39.32

FOREIGN PATENT DOCUMENTS 1053846 1/1967 United Kingdom .
1059876 2/1967 United Kingdom .
1179899 2/1970 United Kingdom .
1442860 7/1976 United Kingdom .
2010969 7/1979 United Kingdom .
2021696 12/1979 United Kingdom .
2119857 11/1983 United Kingdom .

*Primary Examiner*—Louis J. Casaregola
*Attorney, Agent, or Firm*—Oliff & Berridge

[57] ABSTRACT

This invention provides a means for reacting the axial loads $F_A$ experienced by for example, the combustion chamber inner and outer casings 24, 30 and the inlet guide vanes of 26 of the turbine of a gas turbine engine, through the outlet guide vanes 22 of the compressor and to the supportive engine outer casing 28 without imparting a torsional load on the outlet guide vanes 22. The means comprises a plurality of loading bars 32 formed in the combustion chamber outer casing 30 which are angled relative to the applied axial load $F_A$ at the same angle as the chord line C of the outlet guide vanes 22 is angled relative to the engines center line $C_L$. A significant proportion of the axial load $F_A$ is reacted along the load bars 32 and through the vanes 22 without importing twist into said vanes. The comparatively small torsional reaction load required is reacted through the inlet guide vanes 26 of the turbine 16.

8 Claims, 2 Drawing Sheets

AERODYNAMIC LOADING IN GAS TURBINE ENGINES

This invention relates to aerodynamic loading in gas turbine engines and is particularly relevant to the re-orientation of axial loads experienced by various components in such an engine.

Some components in a gas turbine engine experience several different types of loading during operation such as for example axial, torsional, radial and bending loads. This invention is particularly relevant to the first of these loads, however, consideration is also given to torsional loads.

Gas pressures acting on the combustion chamber inner and outer casing as well as the high pressure turbine nozzle guide vanes produce axial and torsional loads which must be reacted out to the engines supportive outer casing. It is common practice to react out the comparatively low torsional loads through the inlet guide vanes in the high pressure turbine. The comparatively high axial loads are reacted through the outlet guide vanes of the high pressure compressor via the combustion chamber outer casing.

Each high pressure compressor outlet guide vane is angled relative to the centre line of the engine in order to direct air into the combustion chamber at the most advantageous angle. A significant aerodynamic advantage may be gained by reducing the thickness of each vane so that it presents as small an obstacle as possible to the incoming airflow.

It has been found that in order to prevent the vanes twisting due to the high axial loads transmitted therethrough it is necessary to have vanes thicker than desirable. It is an object of the present invention to provide a means for re-orientating the axial loads experienced by the high pressure compressor outlet guide vanes which avoids twisting and thereby allow thinner and more aerodynamically efficient vanes to be used.

The present invention will now be more particularly described by way of example only with reference to the accompanying drawings, in which.

Figure 1:
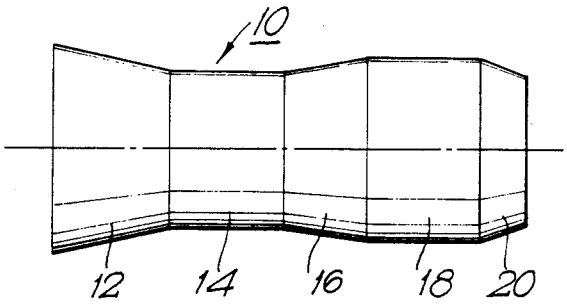
FIG. 1 is a diagrammatic representation of a gas turbine engine.

Referring briefly to FIG. 1, a gas turbine engine 10 generally comprises an axial flow compressor 12, combustion means 14, turbine means 16 connected to the compressor to drive the compressor, a jet pipe 18 and a rear nozzle 20.

Figure 2:
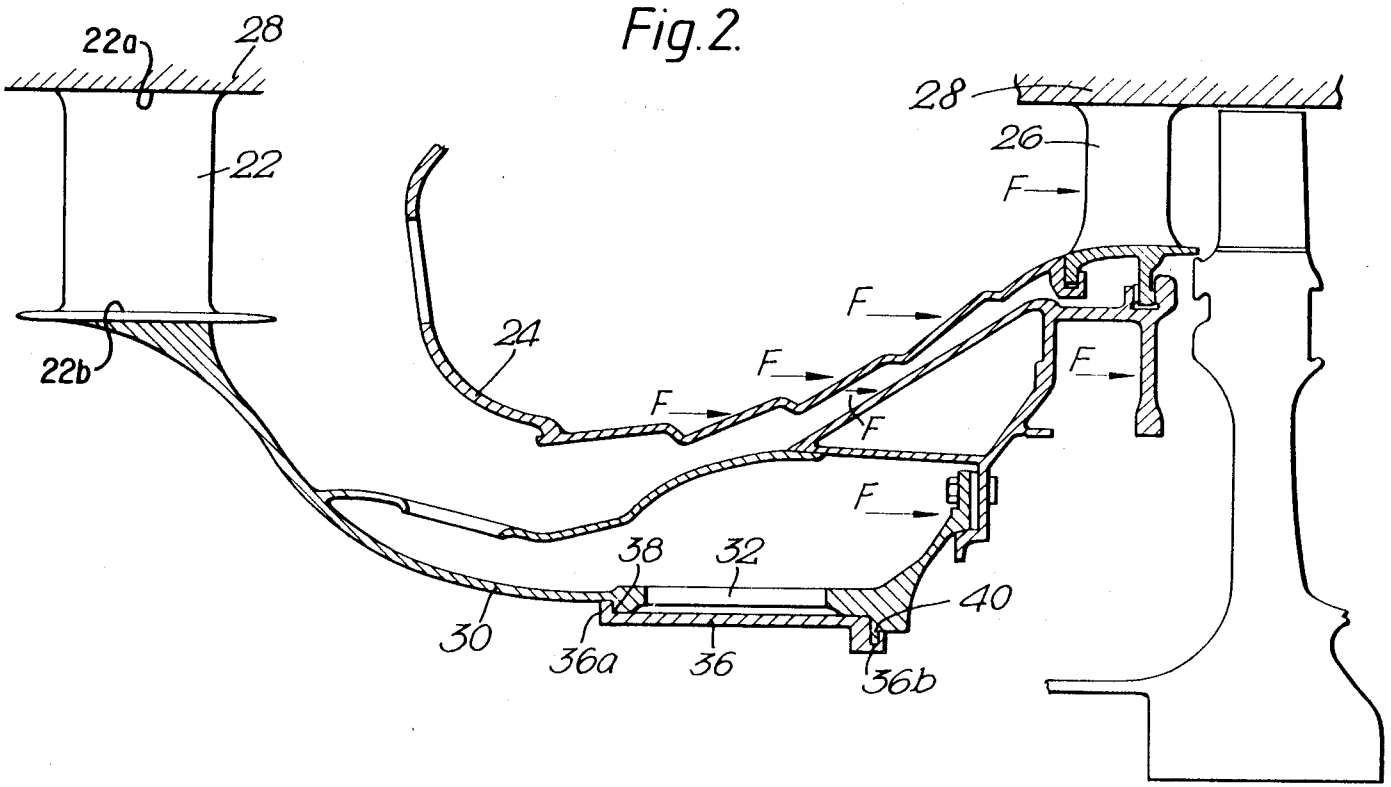
FIG. 2 is a cross sectional view of part of the engine shown in FIG. 1.

In FIG. 2, it can be seen that the engine 10 includes a plurality of circumferentially spaced outlet guide vanes 22 situated in the high pressure portion of the compressor 12, an inner combustion chamber 24 which forms part of the combustion means 14, and a plurality of circumferentially spaced inlet guide vanes 26 situated in the high pressure portion of the turbine 16. The outlet guide vanes 22 are fixedly attached at their radially outer end **22*a* to a portion of the engine casing 28 and at their radially inner end 22*b* to the combustion chamber outer casing 30. The combustion chamber outer casing 30 acts to contain the combustion gasses and is located at its downstream end adjacent to the inlet guide vanes 26 of the high pressure portion of the turbine 16. It will be appreciated that the downstream portions of the inner combustion chamber 24 and combustion chamber outer casing 30 together with the inlet guide vanes 26 experience an axial load F due to the gas pressures acting thereon. The gas pressures can be considerable and are commonly reacted through the combustion chamber outer casing 30 and the outlet guide vanes 22 to the engine casing 28** which acts as a support structure.

It is well known that in order to prevent the above mentioned vanes 22 twisting it is necessary to make them thicker than aerodynamically desirable. It has been found that if the axial load F can be re-orientated such that it is transmitted along the chord line C of the vanes 22 the required load can be reacted by thinner vanes than previously used.

The axial load F is re-orientated by the use of one or more bars 32 positioned circumferentially around the combustion chamber outer casing 30. Each load bar is angled relative to the applied load and the engines centre line $C_L$ by an amount $\theta$ which is equal to the angle $\phi$ at which the chord line of each vane 22 is angled relative to the centre line $C_L$. The load bars 32 are formed by cutting a series of circumferentially spaced slots 34 around the circumference of the combustion chamber outer casing 30. Each slot is angled relative to the engines centre line $C_L$ in the same manner as each loading bar 32 and thereby defines the outer edges **32*a* of each loading bar 32. In order to prevent combustion gasses escaping through the slots 34 a circumferentially extending seal 36 is positioned over the slots as shown in FIG. 2. The seal 36 may be mounted to combustion chamber outer casing 30 by means of circumferentially extending lips 36*a*, 36*b* which mate with features 38, 40 provided on the casing 30**. It will however be appreciated that alternative methods of mounting may be utilised.

Figure 3:
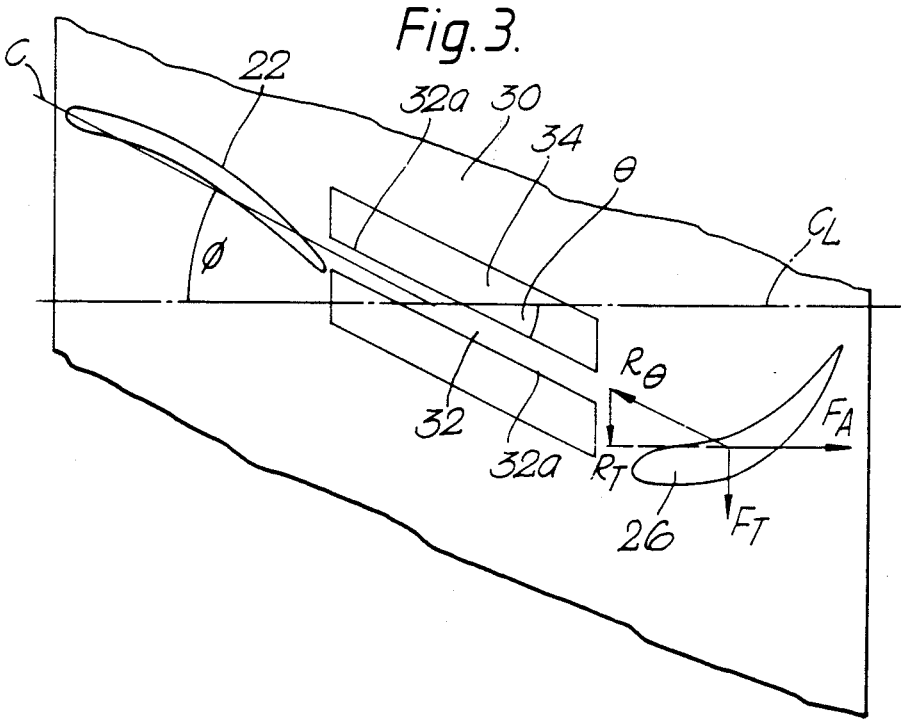
FIG. 3 is a diagrammatic representation of the present invention.

In operation, the combustion chamber inner and outer casings 24, 30 and the inlet guide vanes 26 to the turbine 16 experience high axial loads and possibly a small degree of torsional loading due to the pressure of the combustion gasses, as represented diagrammatically by arrows $F_A$ and $F_T$ on the vane 26 in FIG. 3. Any small torsional load $F_T$ which the combustion chamber casings experience is reacted through the vanes 26 to the outer casing 28.

Bolts or any other similar device may be used to secure the ends of the combustion chamber outer casing 30 to the vanes 26 and hence help transmit the torsional load $F_T$. The direction of the reaction force which reacts the effect of the axial loading $F_A$ is determined by the angular position of the loading bars 32 relative to the centre line $C_L$. The load bars 32 provide a loading path along which a portion of the reaction load $R\theta$ is transmitted. It can be seen from FIG. 3 that if the chord line C of the compressor outlet guide vanes 22 is angled relative to the centre line $C_L$ to the same degree as the loading bars 32 are angled relative to the centre line then that portion of the axial load $F_A$ which is reacted along the loading bars 32 is transmitted to the supportive engine outer casing 28 along the chord line C of the vanes 22. It will be appreciated that twisting of the vanes 22 can be avoided by incorporating this method of load reaction as the vane experiences no torsional force. It will also be seen from FIG. 3 that in order to balance the reaction force which counteracts the effect of the axial load $F_A$ a small torsional reaction load $R_T$ is required. The torsional reaction load $R_T$ is acceptably small and may be transmitted through the inlet guide vanes 26 in the same manner as the torsional load $F_T$.

It will be appreciated that the effect of reducing the angles $\phi$ and $\theta$ is to allow a greater portion of the axial load to be reacted through the loading bars and the outlet guide vanes 22 and to reduce the magnitude of the reaction load $R_T$.

I claim:

1. A means for re-orienting and reacting an applied axial gas pressure load experienced by a combustion chamber in a gas turbine engine having a compressor with outlet guide vanes situated therein, each vane having a chord line, the means comprising: a load bar, angled relative to the applied load and being integrally provided in said combustion chamber with an end associated with an outlet guide vane of the compressor; the chord line of each outlet guide vane being angled relative to the applied load to be parallel to the load bar.

2. A means as claimed in claim 1 in which there is provided a means for reacting to torsional movement of the combustion chamber relative to the outlet guide vane.

3. A means as claimed in claim 1 in which there is provided a means for reacting to torsional movement of the combustion chamber relative to a second component which comprises an inlet guide vane in the high pressure turbine of said engine.

4. A means as claimed in claim 1 wherein the combustion chamber further comprises a combustion chamber outer casing of said engine having the load bar integral thereto.

5. A means as claimed in claim 1 wherein the combustion chamber further comprises a combustion chamber outer casing and any structure carried by the combustion chamber outer casing which is subjected to an axial load, the load bar being integral to the combustion chamber outer casing.

6. A means as claimed in claim 1 in which there is provided a means for reacting to torsional movement of the combustion chamber relative to a second component which comprises a plurality of inlet guide vanes in the high pressure turbine of said engine and each inlet guide vane is provided with at least one load bar associated therewith.

7. A means as claimed in claim 6 in which each load bar forms part of the combustion chamber outer casing and is spaced from its neighbor by a predetermined amount.

8. A means as claimed in claim 6 in which each load bar forms part of the combustion chamber outer casing and is spaced from its neighbor by a predetermined amount and in which a seal is provided to seal the gap between each load bar.

* * * * *